US005152227A

United States Patent [19]

Kato

[11] Patent Number: 5,152,227

[45] Date of Patent: Oct. 6, 1992

[54] LEVITATION-MAGNETIC-FORCE GENERATING APPARATUS FOR MAGNETIC LEVITATION TRANSPORT VEHICLE

[75] Inventor: Junro Kato, Ibaragi, Japan

[73] Assignee: HSST Corporation, Tokyo, Japan

[21] Appl. No.: 840,143

[22] Filed: Feb. 24, 1992

[30] Foreign Application Priority Data

Feb. 25, 1991 [JP] Japan ..... 3-30366

[51] Int. Cl.[5] ..... B61B 13/04

[52] U.S. Cl. ..... 104/286; 104/282

[58] Field of Search ..... 104/281, 282, 286, 290, 104/292, 294; 335/219, 297, 296

[56] References Cited

U.S. PATENT DOCUMENTS

| | | | |
|---|---|---|---|
| 3,780,668 | 12/1973 | Schwarzler et al. | 104/286 |
| 3,804,022 | 4/1974 | Schwarzler et al. | 104/286 |
| 3,842,748 | 10/1974 | Schwarzler et al. | 104/286 |
| 4,123,976 | 11/1978 | Nakamura et al. | 104/286 |
| 4,198,910 | 4/1980 | Gottzein et al. | 104/281 |
| 4,259,908 | 4/1981 | Feistkorn et al. | 104/294 |

FOREIGN PATENT DOCUMENTS

| | | | |
|---|---|---|---|
| 2146141 | 10/1979 | Fed. Rep. of Germany | 104/286 |
| 0210807 | 9/1987 | Japan | 104/281 |

*Primary Examiner*—Robert J. Oberleitner
*Assistant Examiner*—Mark T. Le
*Attorney, Agent, or Firm*—Koda and Androlia

[57] ABSTRACT

A levitation-magnetic-force generating apparatus for linear motor cars including a plurality of electromagnets having a one and single core. The core comprises two plate-like side iron cores arranged in parallel with each other and separated from each other by a gap and a plurality of center iron cores located between the two side iron cores and separated with each other by another gap. Both side edges of each center iron core are fixed to the side iron cores by welding. Each of the center iron cores has a magnetic coil wound around the periphery thereof. The core is mounted in a truck body of a body of the linear motor car so that the longitudinal axis of the core is directed in parallel to the moving direction of the car's body.

6 Claims, 7 Drawing Sheets

LEVITATION-MAGNETIC-FORCE GENERATING APPARATUS FOR MAGNETIC LEVITATION TRANSPORT VEHICLE

BACKGROUND OF THE INVENTION

1. Field of the Invention

The present invention relates to a magnetic-force generating apparatus for generating magnetic force for levitating a transport vehicle adopting a magnetic levitation system off the surface of a rail.

2. Description of the Prior Art

In general, a transport vehicle employing a linear motor system and a magnetic levitation system is levitated off the surface of a rail fixed on a track girder by means of magnetic force generated by a magnetic-force generating apparatus installed on a body of the transport vehicle. The magnetic-force generating apparatus comprises a plurality of electromagnets. The transport vehicle is moved by means of a thrust force generated by linear motor including a metal plate fixed on the track girder or the rail and a field magnet body of a linear motor installed on the body of the transport vehicle.

A plurality of truck bodies are installed on the lower portion of the body of the transport vehicle on both sides of the body with respect to the moving direction of the transport vehicle and in parallel with said moving direction. Each truck body is equipped with a levitation-magnetic-force generating apparatus comprising a plurality of electromagnets. The number of electromagnets included in a levitation-magnetic-force generating apparatus is usually a multiple of two. The electromagnets are arranged to line in a row in the moving direction of the transport vehicle. In the case of a transport vehicle adopting a normal-conducting magnetic levitation system, the levitation-magnetic-force generating apparatus generates magnetic force that serves as an attraction for levitating the transport vehicle off the surface of the rail.

While the transport vehicle is travelling along the rails, the levitation-magnetic-force generating apparatus generates magnetic force for guiding the apparatus to travel along the rails smoothly, and at the same time, for preventing pitching of the vehicle, that is tilting movement of the vehicle body in the longitudinal direction thereof and inclination and movement of the vehicle body in the transverse direction thereof as well. It should be noted that the magnitude of the magnetic force generated by the levitation-magnetic-force generating apparatus for levitating the body of the transport vehicle off the surface of the rail is usually determined so as to levitate the interfacing surfaces of the cores of the electromagnets generating the magnetic force away from the top surface of the rail by a gap of the order of 6 to 10 mm. In spite of the fact that such a small gap is to be sustained, there are variations in manufacturing precision of the electromagnets and variations in installment accuracy of the electromagnets on the truck body. Accordingly, while the transport vehicle is travelling, the cores of the electromagnets fixed on the levitation-magnetic-force generating apparatus may come into contact with the rail or joints of the rail.

SUMMARY OF THE INVENTION

It is a primary object of the present invention to provide a levitation-magnetic-force generating apparatus that allows a plurality of electromagnets to be fixed on a truck body installed on a transport vehicle adopting a magnetic levitation system with high accuracy in relative position among the electromagnets.

It is another object of the present invention to provide a levitation-magnetic-force generating apparatus that allows a plurality of electromagnets to be fixed on a truck body installed on the transport vehicle adopting a magnetic levitation system in such a way that end surfaces of iron cores of the electromagnets exposed and opposed to a rail are positioned on the same plane.

It is still another object of the present invention to provide a levitation-magnetic-force generating apparatus that allows a plurality of electromagnets to be fixed on a truck body on the vehicle body of a transport vehicle adopting a magnetic levitation system in such a way that a gap between the interfacing surfaces of iron cores of the electromagnets and the rail is kept uniform when bending of the truck body is transmitted to the levitation-magnetic-force generating apparatus which is caused by reducing weight of the truck body, during the transport vehicle is travelling.

Generally speaking, the levitation-magnetic-force generating apparatus for transport vehicle adopting a magnetic levitation system in accordance with the present invention includes one and single iron core formed with a plurality of center iron cores fixed between a first side iron core and a second side iron core and a magnetic coil wound around each of the center iron cores. The first side iron core is secured to a truck body installed on the lower portion of the body of the transport vehicle adopting the magnetic levitation system with fixing means provided to the first side iron core in such a way that the top edges of the first side iron core and the second side iron core are exposed and opposed to a rail.

The first and second side cores are each made of a plate having a flat top edge and positioned in such a way that they are separated away from each other by a first predetermined distance and their longitudinal directions are directed in parallel with each other. A plurality of center iron cores are lcoated between the first and second side iron cores with one separated from another by a second predetermined distance in the longitudinal direction of the side iron cores. The distance from one central core to another is large enough to allow a magnetic coil to be wound around each of the center iron cores. One surface of each of the center iron cores facing to the top edges of the first and second side iron cores are all placed on the same plane. Distance between each of said surfaces of the center iron cores and the top edge of the first side iron core are made equal with each other so as to make said plane in parallel with the top edge of the first side iron core. In addition, the distance between each of said surfaces of the center iron cores and the top edge of the second side iron core are made equal with each other so as to make said plane in parallel with the top edge of the second side iron cores. With such an arrangement, enough space is provided between the first and second side iron cores which allows a magnetic coil to be wound around each of the center iron cores.

On the surfaces of the first and second side iron cores exposed to the gap between any adjacent two of the center iron cores, cavities are provided or through holes are formed for reducing cross-sectional areas of the side iron cores between any two adjacent magnetic coils through which magnetic flux passes.

The levitation-magnetic-force generating apparatus for transport vehicle adopting a magnetic levitation system in accordance with the present invention includes one and single core comprising a plurality of center iron cores and first and second side iron cores fixed to both ends of each of the center iron cores. In this way, the levitation-magnetic-force generating apparatus in accordance with the present invention is configured to include a plurality of electromagnets which are equipped with the first and second side iron cores as common side iron cores. Accordingly, when the electromagnets are excited, lines of magnetic force originated from the center iron cores with the magnetic coils wound around them pass through the first or second side iron core, the rail and the second or first side iron core, returning to the center iron cores. Such lines of magnetic force produce attraction force between the rail and the single core which can be used for levitating the body of the transport vehicle adopting the magnetic levitation system off the rail.

In the levitation-magnetic-force generating apparatus according to the present invention, the one and single core can be secured to the truck body formed at the lower portion of the body of the transport vehicle adopting the magnetic levitation system by utilizing fixing means provided to the first side iron core, one of the components of the levitation-magnetic-force generating apparatus . In this way, the electromagnets can be secured to the truck body in position where the upper edges of the first and second side iron cores are made exposed and opposed to the rail, resulting in an easy installation. In addition, since the first and second side iron cores exposed and opposed to the rail are common to all the electromagnets, the dimensions of the gaps between the top edges of the first and second side iron cores and the rail can be made uniform for all th electromagnets.

The levitation-magnetic-force generating apparatus according to the present invention includes a single core comprising a first side iron core and a second side iron core which can each be made of a plate of which cross section perpendicular to the longitudinal direction being a rectangular form uniform over the entire longitudinal length of the plate, the core can be manufactured with ease. In addition, either holes or cavities are provided in the first and second side iron cores at positions exposing to a gap between any adjacent two of the center iron cores. Such holes or cavities reduce the cross-sectional area of the side iron cores located between any two of the magnetic coils adjacent to each other through which leakage magnetic flux passes.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through several views and wherein:

As shown in FIG. 1, a linear motor car 1 adopting normal-conductive magnetic levitation system, a typical transport vehicle adopting a magnetic levitation system, is running along rails 7 installed on a track girder 5 with its body 2 supported by air springs 3 upon a plurality of truck bodies 4.

FIG. 2 shows an enlarged cross section of the transport vehicle in FIG. 1 along a line II—II. The rails 7 are installed on brackets 6 fixed to both sides of the track girder 5. The rails 7 protrude out from both sides of top portion of the track girder 5 all the way along the longitudinal direction thereof.

Each of the truck bodies 4 is equipped with a plurality of field magnet bodies 8 constituting a driving linear motor exposed and opposed to the upper surface of the rail 7. Each of the field magnet bodies is delivered a current corresponding to three-phase alternating current in order to create a magnetic field which in turn produces a thrusting force in the longitudinal direction of the rails 7 in cooperation with the rail 7 which is laminated with a plate made of copper or aluminum on the top surface thereof. Each of the truck bodies 4 is also equipped with a levitation-magnetic-force generating apparatus 9 exposed and opposed to the lower surface of the rail 7. By delivering direct current to electromagnets of the levitation-magnetic-force generating apparatus 9, an attracting force is generating between the electromagnets and the rail 7, levitating the truck body 4 off the rail 7. Each of the truck bodies 4 includes an upper beam 10 for holding and supporting the field magnet body 8 of the driving linear motor and a lower beam 11 for holding and supporting the levitation-magnetic-force generating apparatus 9. As shown in FIG. 2, a pair of truck bodies, 4 arranged on both the sides of the vehicle body 2 are linked with each other by a plurality of beams installed in the transverse direction of the vehicle body 2.

FIG. 3 shows a side view of a truck body as seen from a center line along the moving direction of the vehicle body 2. The upper and lower beams 10 and 11 are installed in such a way that the longitudinal direction thereof are in parallel with the moving direction of the vehicle body 2. The levitation-magnetic-force generating apparatus 9 has one and single core 12 the longitudinal direction thereof is in parallel with the longitudinal direction of the lower beam 11, i.e. the moving direction of the vehicle body 2. The single core 12 having about the same length as the entire length of the truck body 4 is removably fixed to the side surface of the lower beam 11.

Figure 1:
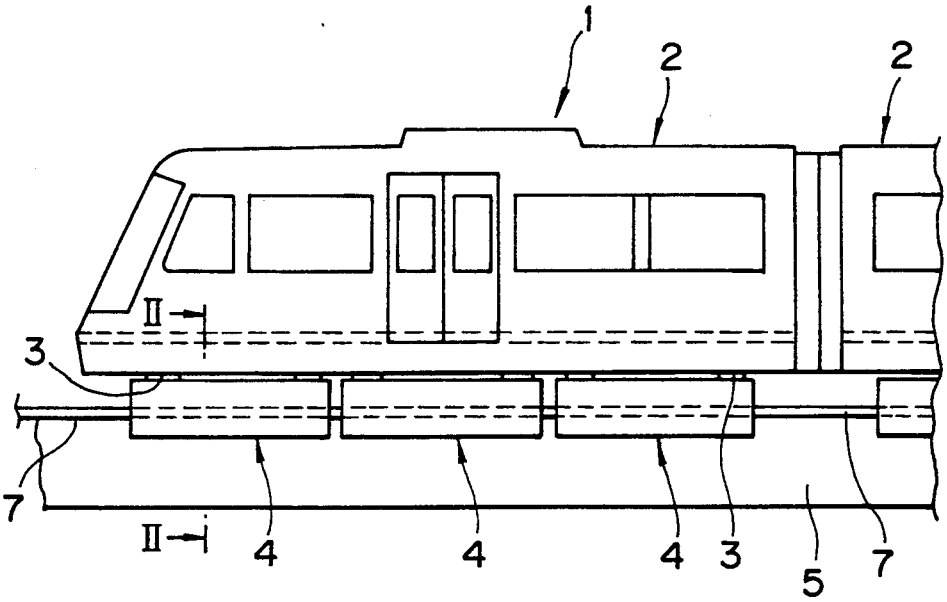
FIG. 1 shows a side view of a transport vehicle adopting a levitation magnetic system and having levitation-magnetic-force generating apparatuses in accordance with the present invention; the figure shows a state in which the transport vehicle is travelling along rails on a track girder.
Figure 2:
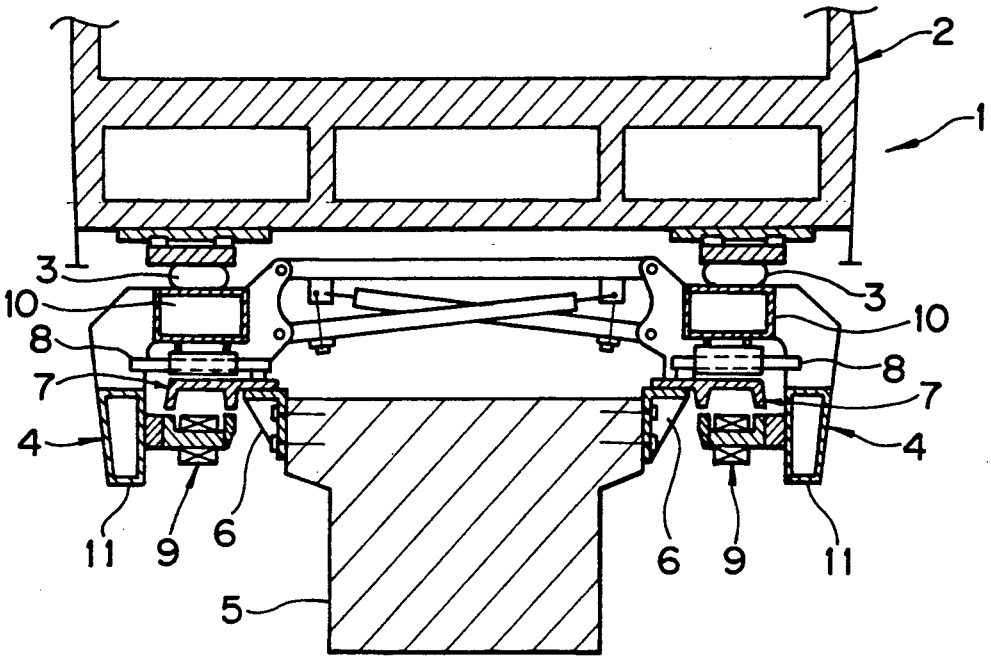
FIG. 2 is a cross-sectional view of the transport vehicle along a line II—II shown in FIG. 1.
Figure 3:
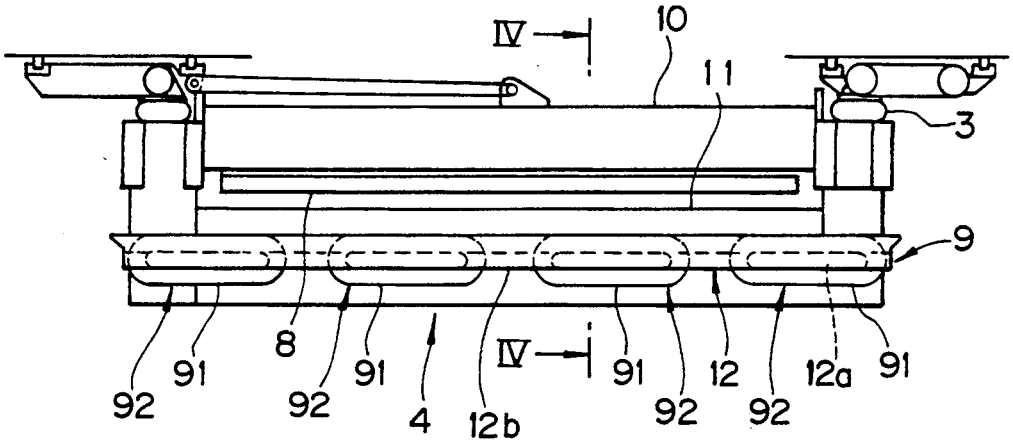
FIG. 3 shows a side view of a truck body provided with an embodiment according to the present invention.

The core 12 comprises four center iron cores 12*a* and a pair of side iron cores 12*b*, 12*b*. The side iron cores 12*b*, 12*b* are fixed to both end edges of the center cores 12*a* to form a U-shaped in a cross section perpendicular to the longitudinal direction of the core 12. Each of the center iron cores 12*a* is made of a material having a high saturated flux density such as malleable iron, cobalt steel, etc. The cross section of each of the center iron cores 12*a* is formed into a rectangular plate. Generally, the center iron cores 12*a* all have the same dimensions. The two side iron cores 12*b*, 12*b* are each made of mild steel which is less expensive and formed in a plate, respectively. It is obvious from FIGS. 4 and 5 that the transverse direction of the two side iron cores 12*b*, 12*b* are arranged in parallel with the vertical direction of the truck body 4. The center iron cores 12*a* are arranged along the lower edges of the side iron cores 12*b*, 12*b*. The side iron cores 12*b*, 12*b* are fixed to both side edges of the center cores 12*a* to form the core 12 by fixing means such as bolt-fastening, welding, etc. The core 12 is formed such that the upper surfaces of the four center iron cores 12*a* are all leveled on the same plane and separated away with each other in the longitudinal direction of the side iron cores 12*b*, 12*b*. The distance between each of said upper surfaces of the center iron cores 12*a* and top edge of one of the side iron core 12*b* are made equal with each other. Similarly, the distance between each of said upper surface of the center iron cores 12*a* and top edge of the other of the side iron core 12*b* are made equal with each other. Accordingly, said plane in which all the upper surfaces of the center iron cores 12*a* are included is located in parallel with the top edges of the side iron cores 12*b* and 12*b*, respectively. In addition, the four center iron cores 12*a* are fixed at predetermined equal intervals in the longitudinal direction of the two side iron cores 12*b*, 12*b*.

Each of the center iron cores 12*a* constituting the core 12 in conjunction with the side iron cores 12*b* as described above has an exciting coil 91 wound around the periphery thereof. A gap between two adjacent center iron cores 12*a* is set to allow for a space that prevents two adjacent coils 91 from interfering with each other. The distance from the upper surface of the center iron cores 12*a* to the top edges of the side iron cores 12*b* are set to allow for a space which guarantees that the exciting coils 91 can be wound around the central cores 12*a* without coming in contact with the rail 7. The four center iron cores 12*a* and the four coils 91 wounded around the respective center iron cores 12*a* are lined to form a row of four electromagnets 92 on the levitation-magnetic-force generating apparatus 9.

Figure 4:
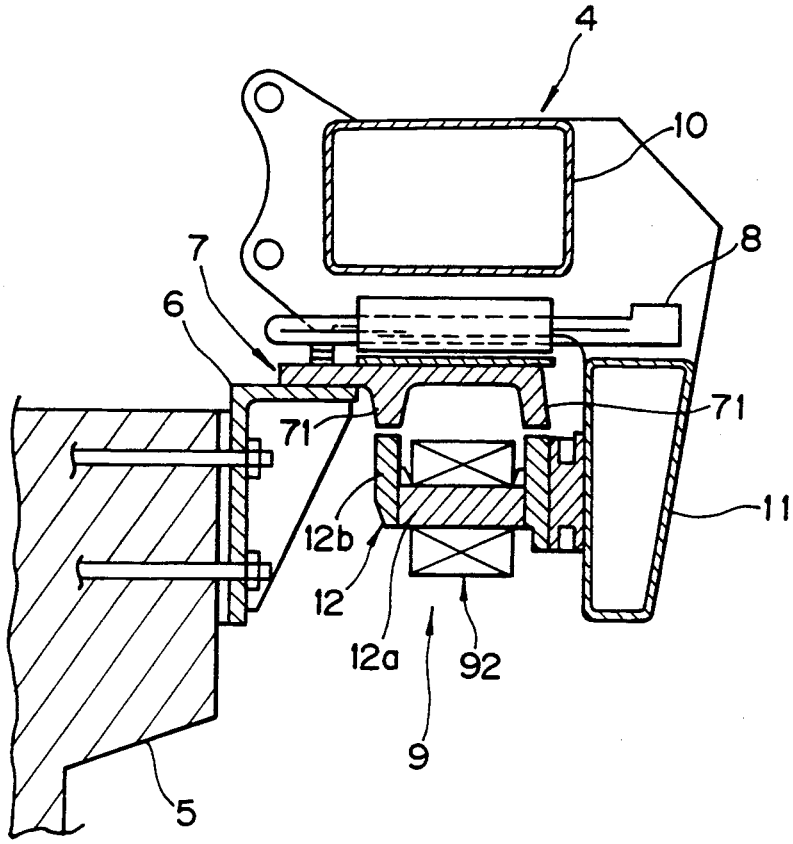
FIG. 4 is a cross-sectional view of the truck body along a line IV—IV shown in FIG. 3
Figure 5:
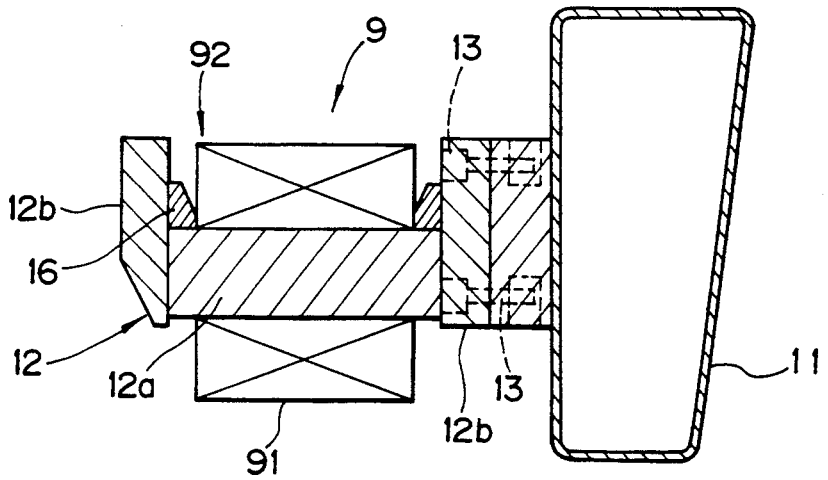
FIG. 5 is a front cross-sectional view of the embodiment shown in FIG. 3.

As shown in FIG. 4, two protrusions 71 are protruded downward out off the lower surface of the rail 7 and in parallel with the longitudinal direction of the rail 7. The two side iron cores 12*b*, 12*b* constituting the one and single core 12 of the levitation-magnetic-force generating apparatus 9 are fixed to the central core 12*a*, so as to be separated away from each other by a distance having the same length as a distance between the protrusions 71. The top edges of the side iron cores 12*b*, 12*b* of the core 12 are exposed and opposed to the edges of the protrusions 71, respectively. In addition, one of the side iron cores 12*b* is fixed to the side surface of the lower beam 11 by bolts 13 as shown in FIG. 5. It is noted that the bolts 13 are deliberately used so as to allow the core 12 to be removed freely from the lower beam 11 when necessary.

When direct current flows through the coils 91, the core 12 of the electromagnets 92 of the levitation-magnetic-force generating apparatus 9 each is strongly magnetized which, in turn, produces an attraction force between the core 12 and the rail 7. The attraction force appears between the top edges of the side iron cores 12*b* of the core 12 and the edges of the protrusions 71 on the rail 7. The attraction force levitates the truck body 4 and the vehicle body 2 and, at the same time, resists movement of the truck body 4 and the vehicle body 2 in the transverse direction of the rail 7. The four center iron cores 12*a* of the four electromagnets 92 are each fixed to the side iron cores 12*b*, 12*b* so as to form the one and single core 12 and no deviation between the positions of the four electromagnets 92 may occur at the time of installation to the truck body 4.

Figure 6:
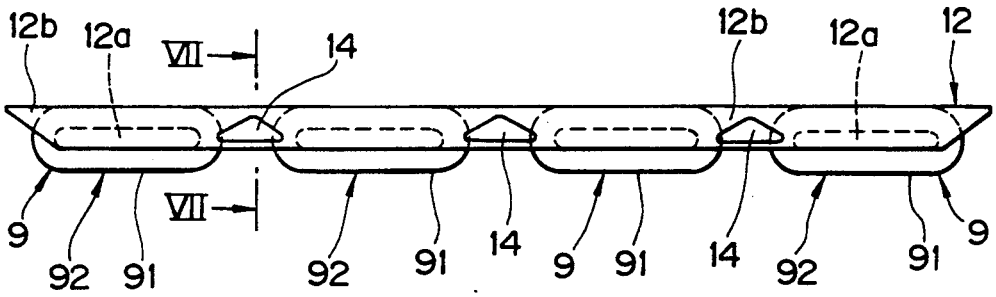
FIG. 6 shows a side view of another embodiment according to the present invention.
Figure 7:
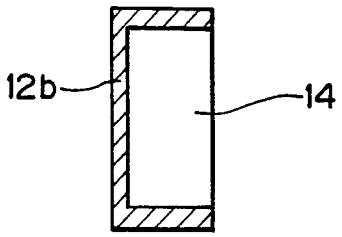
FIG. 7 is a cross-sectional view of the embodiment along a line VII—VII shown in FIG. 6.

As such, the four electromagnets 92 each have a center iron core 12*a* with an exciting coil 91 wound around the iron core 12*a*. Accordingly, the electromagnets 92 can be excited either individually as stand-alone magnets or altogether at the same time. It should be noted, however, that since the center iron cores 12*a* of the electromagnets 92 are fixed to the side iron cores 12*b* which are common to all the electromagnets 92, magnetic flux leaks through the side iron cores 12*b* to adjacent electromagnets 92. In order to reduce the amount of the leakage magnetic flux, a cavity 14 is formed on the surface of each of the side iron cores 12*b* at the positions of the side iron cores 12*b* exposed to the gap between two adjacent center iron cores 12*a* as shown in FIGS. 6 and 7. The cavity 14 has a large dimension as required to prevent the core 12 from impairing strength thereof. Instead of forming the cavity 14, a through hole may be formed.

Figure 8:
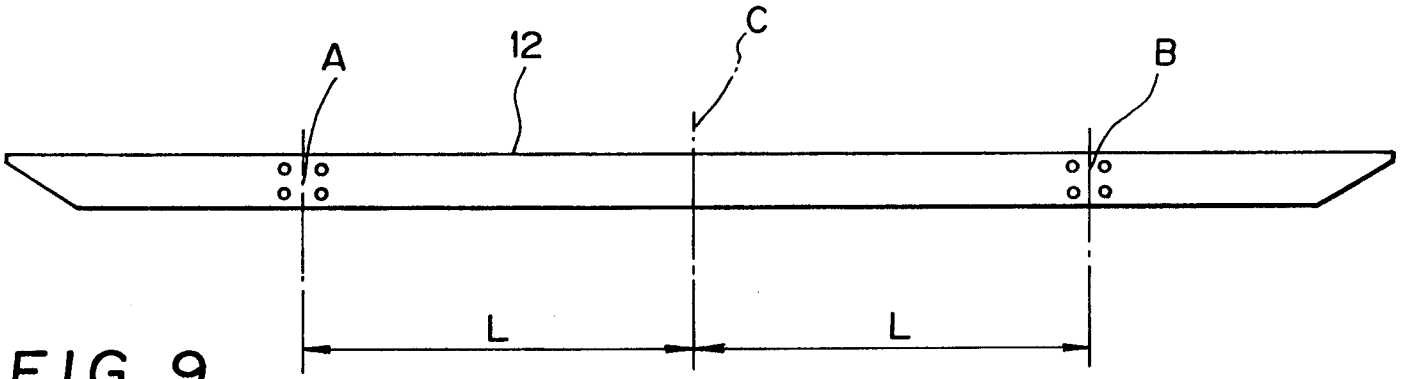
FIG. 8 shows a side view of a first side iron core of still another embodiment according to the present invention.
Figure 9:
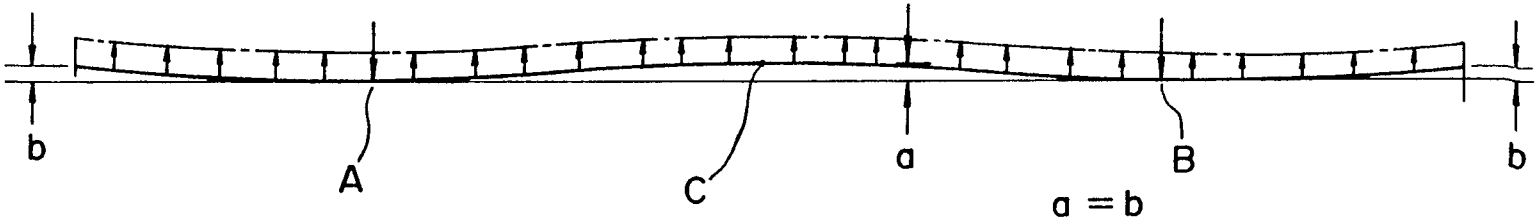
FIG. 9 is a diagram showing bending forces applied to the first side iron core shown in FIG. 8.

The attraction force generated between the electromagnets 92 of the levitation-magnetic-force generating apparatus 9 and the rail 7 levitates the vehicle body 2 and the truck body 4 off the rail 7, serving as an opposing counterbalance to the weight of the vehicle body 2. As such, the vehicle body 2 is supported by the core 12 of the levitation-magnetic-force generating apparatus 9 and the lower beam 11 of the truck body 4 bearing the core 12. In that posture, the levitation force as the counterbalance to the weight of the vehicle body 2, causes the cores 12 to be deformed. In order to reduce the amount of deformation of the core 12, the core 12 is fixed to the lower beam 11 at two points A and B by using the bolts 13 as shown in FIG. 8. As shown in FIG. 9, the points A and B are both separated away from a center line C of the length in the longitudinal direction of the core 12 by a distance L. The length of the distance L is determined so that the amount of a bend (a) on a portion crossed by the center line C is equal to the amount of a bend (b) on each longitudinal end. In this way, the bend of the core 12 can be reduced considerably. In addition, no hindrance is proved to the travelling of the vehicle body 2. It is noted that the distance L can be calculated by computation based on the beam theory.

As described above, in accordance with the present invention, portions of the core 12 of the electromagnets 92 of the levitation-magnetic-force generating apparatus 9 which are exposed and opposed to the protrusions 71 on the rail 7 are the top edges of the side iron cores 12*b* common to the four electromagnets 92. Accordingly, the vehicle body 2 can be levitated off the rail 7 with uniform distance in gap between the side iron cores 12*b* and the rail 7 with respect to four electromagnets 92. As a result, the core 12 will not come in contact with the rail 7 or joints of the rail 7.

Figure 10:
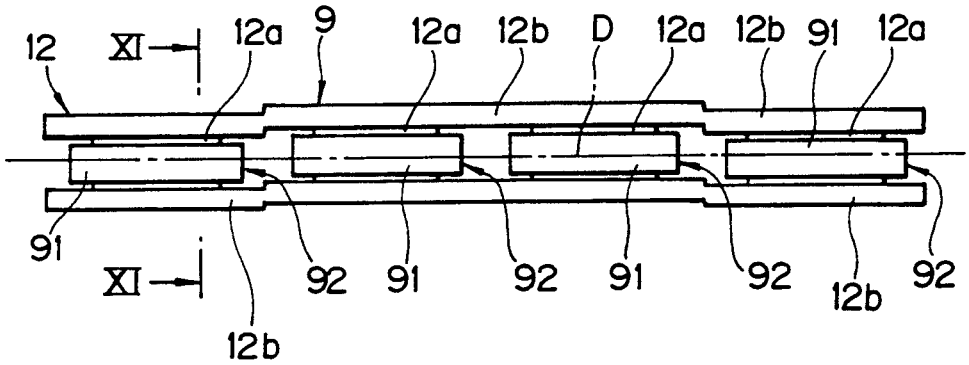
FIG. 10 is a plan view of another embodiment according to the present invention.
Figure 11:
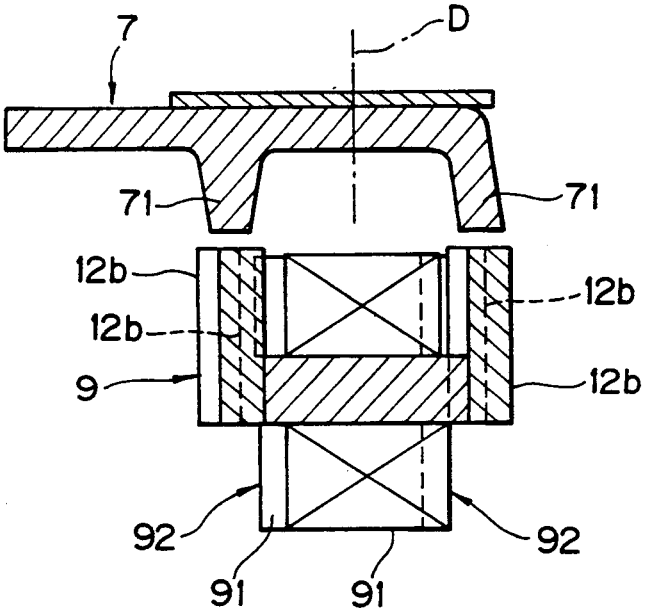
FIG. 11 is a cross-sectional view of the embodiment along a line XI—XI shown in FIG. 10.

FIGS. 10 and 11 show another embodiment implementing a levitation-magnetic-force generating apparatus 9 in accordance with the present invention. The embodiment includes a row of four electromagnets 92 along the longitudinal direction of a core 12. The positions of electromagnets 92 are shifted in the transverse direction of the core 12 away from a line D passing through the center of the gap between two protrusions 71 formed on the lower surface of a rail 7. As shown in FIG. 10, the two electromagnets 92 formed at the longitudinal ends of the core 12 are shifted downward in the figure so that the center lines of their exciting coils 91 and side iron cores 12*b* are positioned below the center line D in the figure. On the other hand, the remaining two electromagnets 92 formed in close proximity to the longitudinal center of the core 12 are shifted upward in the figure so that the center lines of their exciting coils 91 and side iron cores 12*b* are positioned above the center line D in the figure. According to this embodiment, each truck body 4 is equipped with one unit of levitation-magnetic-force generating apparatus 9 which is capable of generating a force for levitating a vehicle body 2 off the rail 7 and a force for suppressing movement of the vehicle body 2 in the transverse direction of the rail 7. Accordingly, by equipping each truck body 4 with one unit of levitation-magnetic-force generating apparatus 9 implemented by this embodiment and installing six truck bodies 4 on every vehicle body 2 as shown in FIG. 1, the movement of the vehicle body 2 in the transverse direction of the rail 7 can be suppressed effectively while the transport vehicle 1 is travelling.

Figure 12:
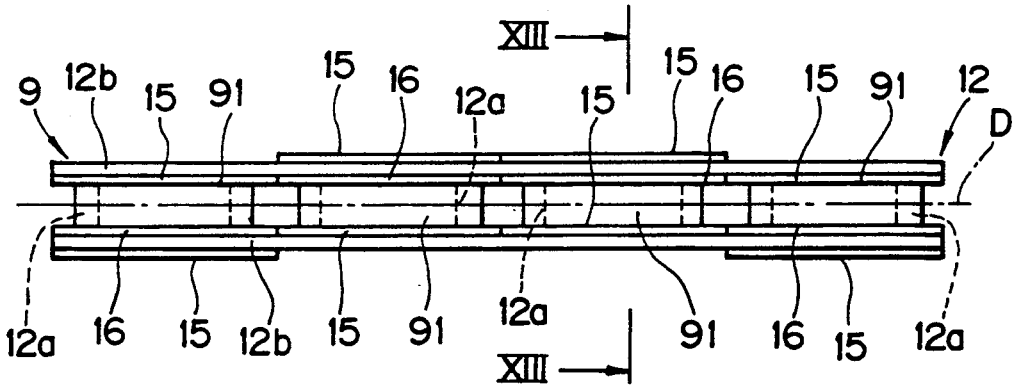
FIG. 12 is a plan view of still another embodiment according to the present invention.
Figure 13:
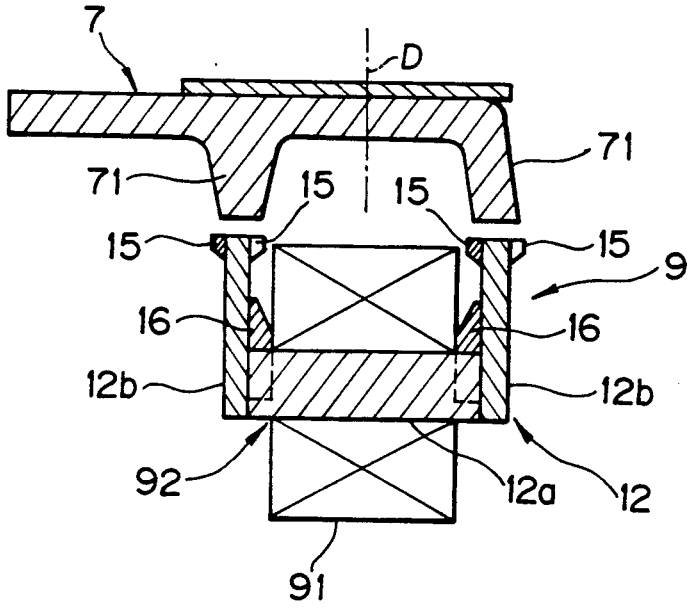
FIG. 13 is a cross-sectional view of the embodiment along a line XIII—XIII shown in FIG. 11.

FIGS. 12 and 13 show still another embodiment implementing a levitation-magnetic-force generating apparatus 9 in accordance with the present invention. The levitation-magnetic-force generating apparatus 9 has a core 12 which basically has a structure similar to the one explained by referring to FIGS. 4 and 5. Accordingly, in this embodiment, the core 12 also includes side iron cords 12*b* exposed to exciting coils 91 of electromagnets 92. On the top edges of the side iron cores 12*b*, longitudinal protrusions 15 are formed in parallel with the longitudinal direction of the core 12 at positions corresponding to each of the electromagnets 92. The longitudinal protrusions 15 protrude out off the side surfaces of the side cores 12*b* in the transverse direction of the core 12 perpendicular to said center line D. As showm in FIG. 12, the two electromagnets 92 are formed at the longitudinal ends of the core 12. In these two electromagnets 92, the longitudinal protrusions 15 protrude downward out off the side surfaces of the side iron cores 12*b*, 12*b* in the figure. Additional two electromagnets 92 are formed in close proximity to the longitudinal center of the core 12. In these two center electromagnets 92, on the contrary, the longitudinal protrusions 15 protrude upward out off the side surfaces of the side iron cores 12*b*, 12*b* in the figure. The longitudinal protrusions 15 are made of the same material as the side iron cores 12*b* and fixed to the side iron cores 12*b* either by welding or using bolts. Much like the levitation-magnetic-force generating apparatus 9 shown in FIGS. 10 and 11, the one implemented by this embodiment also generates force for suppressing the movement of the vehicle body 2 in the transverse direction of the rail 7 as well. However, the levitation-magnetic-force generating apparatus 9 implemented by this embodiment is easier to manufacture than the one shown in FIGS. 10 and 11.

Figure 14:
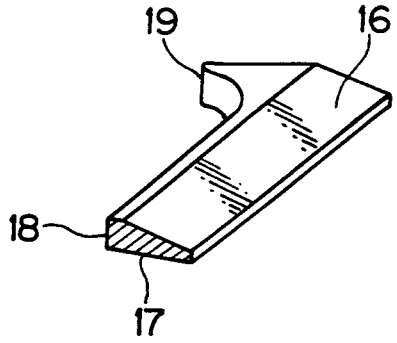
FIG. 14 shows a perspective view of part of an auxiliary core and FIG. 15 shows a side view of still another embodiment according to the present invention.

FIG. 14 shows a portion of an auxiliary core 16 which is typically made of pure iron, cobalt steel, mild steel, etc.. As shown in the figure, the auxiliary core 16 is formed into a plate with a cross section almost resembling a right-angled triangle having an acute vertical angle. Side surfaces 17 and 18 are respectively shown as long and short sides forming the right angle of the cross section. The side surfaces 17 and 18 come in contact with the inner wall of the side iron core 12*b* and the upper surface of a center iron core 12*a*, respectively. The side surface 18 has protruded engaging portions 19 at both ends thereof. The engaging portions 19 are engaged with both ends of the center iron core 12*a* to join the auxiliary core 16 and the core 12 into a fixed single body. In the levitation-magnetic-force generating apparatus 9 according to the present invention, when the exciting coils 91 are excited, lines of magnetic force in the center iron cores 12*a* pass through the side iron cores 12*b* and the rail 7, resulting generation of attraction force. As the lines of magnetic force are transmitted from the center iron cores 12*a* to the side cores 12*b*, a large change in cross-sectional area of the core 12 serves as a magnetic resistance which, in turn, contributes to an increase in leakage resistance. An increase in leakage resistance naturally gives rise to reduced attraction force. The auxiliary core 16 plays a role of making the path of the lines of magnetic force smooth and, thus, reducing leakage magnetic flux.

Figure 15:
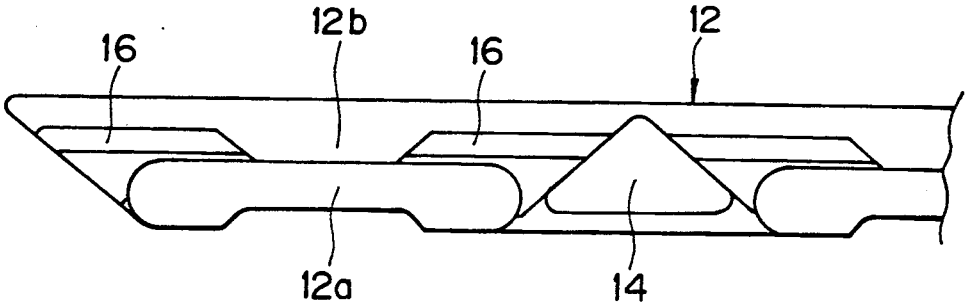

FIG. 15 shows a side view of another form of the core 12 shown in FIGS. 12 and 13.

What is claimed is:

1. A levitation-magnetic-force generating apparatus for a magnetic levitaiton transport vehicle comprising:

one and single core having a first side iron core in a plate form with a flat top edge, a second side iron core in a plate form with a flat top edge arranged longitudinal direction thereof in parallel with the longitudinal direction of said first side iron core and located apart from said first side iron core by a first predetermiend distance, and a plurality of center iron cores located between said first side iron core and said second side iron core and arranged apart from each other in the longitudinal direction of said first side core and said second side core by a second predetermined distance;

a pluarlity of exciting coils located between said first side iron core and said second side iron core and wounded around each of said center iron cores, respectively;

a fixing means for fixing said first side iron core to a truck body formed at a lower portion of a body of said transport vehicle with the longitudinal direction of said first side iron core in parallel with the travelling direction of said transport vehicle;

surfaces of said center iron cores facing to top edges of said first and second side iron cores being located on a same plane;

distance between each of said surfaces of said center iron cores located in the same plane and said flat top edge of said first side iron core being made equal with each other; and distance between each of said surfaces of said center iron cores located in the same plane and said flat top edge of said second side iron core being made equal with each other.

2. A levitation-magnetic-force generating apparatus according to claim 1, wherein said center iron cores are made of one of iron materials having a high saturated density.

3. A levitation-magnetic-force generating apparatus according to claim 1, wherein one of hole and cavity is formed in said first side iron core and said second side iron core at positions facing to gaps between adjacent two of said center iron cores for reducing the cross-sectional areas of said side iron cores located between adjacent two of said exciting coils through which magnetic flux passes.

4. A levitation-magnetic-force generating apparatus according to claim 1, wherein each of said first side iron core and said second iron core is made of a plate, each of the side iron cores has cross section thereof perpendicular to the longitudinal direction of said plate a rectangular form uniform over the entire longitudinal length thereof, longitudinal protrusions are formed on first and said second side iron cores on top edges of side surfaces thereof at positions corresponding to the positions where said center iron cores are fixed, wherein said longitudinal protrusions protrude out off the surfaces of said first side core and said second side core in directions perpendicular to the longitudinal directions of said first side core and said second side core and the protruding direction of said longitudinal protrusions is different by the position of said center iron cores.

5. A levitation-magnetic-force generating apparatus according to claim 1 wherein each of said first side iron core and said second side iron core is made of a plate, each of the side iron cores has cross section thereof perpendicular to the longitudinal direction of said plate a rectangular form uniform over the entire longitudinal length of thereof, an auxiliary core having a small in dimension is fixed at each of joint portions of said first and second side iron cores to said center iron core in face to face attachments for reducing leakage magnetic flux passing through the space between said center iron cores and said first and second side iron cores whereby leakage magnetic flux passing through said first and second side iron core and said center iron core is reduced.

6. A levitation-magnetic-force generating apparatus according to claim 5, wherein said center iron cores and said auxialary cores are made of iron materials having a high saturated density.

* * * * *